US005679912A

United States Patent [19]

Asai et al.

[11] Patent Number: 5,679,912

[45] Date of Patent: Oct. 21, 1997

[54] MUSIC PRODUCTION AND CONTROL APPARATUS WITH PITCH/TEMPO CONTROL

[75] Inventors: Sanpei Asai; Yoshiyuki Akiba; Masuhiro Sato; Makoto Takanashi, all of Ohta-ku, Japan

[73] Assignee: Pioneer Electronic Corporation, Tokyo, Japan

[21] Appl. No.: 626,665

[22] Filed: Mar. 15, 1996

[30] Foreign Application Priority Data

Mar. 17, 1995 [JP] Japan ..... 7-059467

[51] Int. Cl.[6] ..... A63H 5/00; G04B 13/00; G10H 7/00

[52] U.S. Cl. ..... 84/609; 84/619; 84/645

[58] Field of Search ..... 84/609, 612, 619, 84/645

[56] References Cited

U.S. PATENT DOCUMENTS 4,734,795 3/1988 Fukami et al. .
5,159,141 10/1992 Iba ..... 84/613 X
5,313,011 5/1994 Koguchi ..... 84/609
5,426,540 6/1995 Mikami .
5,447,438 9/1995 Watanabe et al. ..... 84/645 X

*Primary Examiner*—William M. Shoop, Jr.
*Assistant Examiner*—Jeffrey W. Donels
*Attorney, Agent, or Firm*—Ladas & Parry

[57] ABSTRACT

A music reproduction control apparatus includes: a first storing unit for storing main-digital data; a second storing unit for storing sub-digital data; a first reproducing unit for reproducing main-sound based on the stored main-digital data; a second reproducing unit for reproducing sub-sound based on the stored sub-digital data; a receiving unit for receiving an input signal; a first changing unit for changing a reproducing speed of the first reproducing unit based on the received input signal; a second changing unit for changing a reproducing speed of the second reproducing unit based on the received input signal; a correcting unit for correcting a key of the sub-sound in accordance with a change in the reproducing speed of the second reproducing unit; and a synchronizing unit for synchronizing a timing of changing the reproducing speed of the first reproducing unit with a timing of changing the reproducing speed of the second reproducing unit.

14 Claims, 6 Drawing Sheets

MUSIC PRODUCTION AND CONTROL APPARATUS WITH PITCH/TEMPO CONTROL

BACKGROUND OF THE INVENTION

1. Field of the Invention

This invention relates to so-called karaoke system, and more particularly to karaoke system capable of mixing main-sound outputted from a MIDI (Musical Instrument Digital Interface) sound source and sub-sound, which is reproduced from digitized back-chorus data.

2. Description of the Related Art

Conventionally, there is known a MIDI sound source for producing many kinds of music based on digital music data, which consists of musical performance of an electronic piano and a synthesizer.

Recently, so-called communication karaoke system, which uses the MIDI sound source, is spread. In the communication karaoke system, the MIDI sound source is used in order to decrease the quantity of communication data. However, the communication karaoke system outputs music data by encoding the music data based on a MIDI standard, and reproduces music by controlling the MIDI sound source provided in a terminal.

However, with respect to the conventional MIDI sound source, it is difficult to reproduce a subtle tone and the pronunciation of lyrics. Therefore, in case of reproducing human voice as back-chorus, the encoded human voice is separately decoded according to the method defined by ADPCM (Adaptive Differential Pulse Code Modulation) and MPEG (Moving Picture Experts Group) in order to decrease the quantity of the data, and the decoded human voice is superimposed on the music data supplied from the MIDI sound source, and then the music is reproduced.

On the other hand, recently, the karaoke system is constructed so that user can change the reproducing speed of the reproduced music. In order to change the reproducing speed of the reproduced music, the karaoke system should be constructed so that the key of the reproduced music is not changed due to the reproducing speed of the reproduced music being changed.

However, the MIDI sound source, which is based on the MIDI standard, can change the kind of musical instrument, the key of the musical instrument, the volume of the musical instrument and the reproducing speed of the musical instrument, and then reproduce the main-sound, which consists of accompaniment sound.

As explained the above, the MIDI sound source can easily change the kind of musical instrument, the key of the musical instrument, the volume of the musical instrument and the reproducing speed of the musical instrument. However, it is difficult to change the reproducing speed of the sub-sound of the back-chorus in case of the back-chorus data being encoded by the ADPCM.

The reproducing speed of decoded sub-sound can be changed by changing the output rate of a decoder. However, in order to change the output rate of the decoder, the input rate of the decoder should be controlled in accordance with the output rate. However, the conventional converter is constructed so that the input rate and the output rate is constant and it can not be changed.

Further, with respect to the conventional karaoke system, there is a problem that the key of the digitized sub-sound is changed if the reproducing speed of the digitized sub-sound is changed. For example, if the reproducing speed is increased, the key is increased by the same increasing rate as that of the reproducing speed. On the other hand, if the reproducing speed is decreased, the key is decreased by the same decreasing rate as that of the reproducing speed.

Therefore, with respect to the conventional communication karaoke, which uses a music reproduction system, which mixes the main-sound from the MIDI sound source and the digitized sub-sound, if the reproduction speeds of the main sound and the sub-sound are changed, only the main-sound outputted from the MIDI sound source is reproduced and the reproduction of the back-chorus is stopped.

SUMMARY OF THE INVENTION

Accordingly, an object of the present invention is to substantially eliminate defects and drawings encountered in the prior art and to provide a music reproduction control apparatus and a music reproduction apparatus, which can change the reproducing speed of the digitized sub-sound in accordance with the change in the reproducing speed of the main-sound outputted from the MIDI sound source, and in which the key of the sub-sound is not changed if the reproducing speed of thereof is changed.

According to one aspect of the present invention, there is provided a music reproduction control apparatus including: a first storing unit for storing main-digital data; a second storing unit for storing sub-digital data; a first reproducing unit for reproducing main-sound based on the stored main-digital data; a second reproducing unit for reproducing sub-sound based on the stored sub-digital data; a receiving unit for receiving an input signal; a first changing unit for changing a reproducing speed of the first reproducing unit based on the received input signal; a second changing unit for changing a reproducing speed of the second reproducing unit based on the received input signal; a correcting unit for correcting a key of the sub-sound in accordance with a change in the reproducing speed of the second reproducing unit; and a synchronizing unit for synchronizing a timing of changing the reproducing speed of the first reproducing unit with a timing of changing the reproducing speed of the second reproducing unit.

According to the music reproduction control apparatus, main-digital data is stored by a first storing unit and sub-digital data is stored by a second storing unit. Main-sound is reproduced based on the stored main-digital data by a first reproducing unit, and sub-sound is reproduced based on the stored sub-digital data by a second reproducing unit. An input signal is received by a receiving unit. A reproducing speed of the first reproducing unit is changed by a first changing unit based on the received input signal, and a reproducing speed of the second reproducing unit is changed by a second changing unit based on the received input signal. A key of the sub-sound is corrected by a correcting unit in accordance with a change in the reproducing speed of the second reproducing unit and a timing of changing the reproducing speed of the first reproducing unit is synchronized by a synchronizing unit with a timing of changing the reproducing speed of the second reproducing unit.

According to the above music reproduction control apparatus, the second changing unit further includes: a first signal outputting unit for outputting a first signal having a first phase; a second signal outputting unit for outputting a second signal having a second phase, which is changed based on the received input signal; and a phase difference detecting unit for outputting a control signal corresponding to a phase difference between the first phase and the second phase, whereby the second changing unit changes the reproducing speed of the second reproducing unit based on the control signal. A first signal having a first phase is outputted by a first signal outputting unit, and a second signal having a second phase, which is changed based on the received input signal, is outputted by a second signal outputting unit. A control signal corresponding to a phase difference between the first phase and the second phase is outputted by a phase difference detecting unit, and, therefore, the second changing unit changes the reproducing speed of the second reproducing unit based on the control signal.

According to the above music reproduction control apparatus, the correcting unit corrects the key of the sub-sound by a parameter k, which is calculated by the following equation: k=100/ (100+m)−1 [percent], wherein a parameter m [percent] is a changing ratio in the reproducing speed of the second reproducing unit, which is changed based on the input signal.

The above music reproduction control apparatus, further includes a key changing unit for changing a key of the main-sound, wherein the correcting unit corrects the key of the sub-sound in accordance with a change in the reproducing speed of the second reproducing unit and the changed key of the main-sound. A key of the main-sound is changed by a key changing unit, and the correcting unit corrects the key of the sub-sound in accordance with a change in the reproducing speed of the second reproducing unit and the changed key of the main-sound.

According to the music reproduction control apparatus, the correcting unit corrects the key of the sub-sound by a parameter k', which is calculated by the following equation: k'=(100+a) / (100+m)−1 [percent], wherein a parameter a [percent] is a changing ratio in the key of the main-sound and wherein a parameter m [percent] is a changing ratio in the reproducing speed of the second reproducing unit, which is changed based on the input signal.

According to another aspect of the present invention, there is provided a music reproduction apparatus including: a first storing unit for storing main-digital data; a second storing unit for storing sub-digital data; a first reproducing unit for reproducing main-sound based on the stored main-digital data; a second reproducing unit for reproducing sub-sound based on the stored sub-digital data; a receiving unit for receiving an input signal; a first changing unit for changing a reproducing speed of the first reproducing unit based on the received input signal; a second changing unit for changing a reproducing speed of the second reproducing unit based on the received input signal; a correcting unit for correcting a key of the sub-sound in accordance with a change in the reproducing speed of the second reproducing unit; a synchronizing unit for synchronizing a timing of changing the reproducing speed of the first reproducing unit with a timing of changing the reproducing speed of the second reproducing unit; a mixing unit for mixing the main-sound and the sub-sound after the reproducing speed of the first reproducing unit is changed by the first changing unit and the reproducing speed of the second reproducing unit is changed by the second changing unit; and a mixing unit for mixing the main-sound and the sub-sound after the reproducing speed of the first reproducing unit is changed by the first changing unit and the reproducing speed of the second reproducing unit is changed by the second changing unit.

According to the music reproduction apparatus, main-digital data is stored by a first storing unit and sub-digital data is stored by a second storing unit. Main-sound is reproduced based on the stored main-digital data by a first reproducing unit, and sub-sound is reproduced based on the stored sub-digital data by a second reproducing unit. An input signal is received by a receiving unit. A reproducing speed of the first reproducing unit is changed by a first changing unit based on the received input signal, and a reproducing speed of the second reproducing unit is changed by a second changing unit based on the received input signal. A key of the sub-sound is corrected by a correcting unit in accordance with a change in the reproducing speed of the second reproducing unit and a timing of changing the reproducing speed of the first reproducing unit is synchronized by a synchronizing unit with a timing of changing the reproducing speed of the second reproducing unit. The main-sound and the sub-sound are mixed by a mixing unit after the reproducing speed of the first reproducing unit is changed by the first changing unit and the reproducing speed of the second reproducing unit is changed by the second changing unit.

According to the above music reproduction apparatus, the second changing unit further includes: a first signal outputting unit for outputting a first signal having a first phase; a second signal outputting unit for outputting a second signal having a second phase, which is changed based on the received input signal; and a phase difference detecting unit for outputting a control signal corresponding to a phase difference between the first phase and the second phase, whereby the second changing unit changes the reproducing speed of the second reproducing unit based on the control signal. A first signal having a first phase is outputted by a first signal outputting unit, and a second signal having a second phase, which is changed based on the received input signal, is outputted by a second signal outputting unit. A control signal corresponding to a phase difference between the first phase and the second phase is outputted by a phase difference detecting unit, and, therefore, the second changing unit changes the reproducing speed of the second reproducing unit based on the control signal.

According to the above music reproduction apparatus, the correcting unit corrects the key of the sub-sound by a parameter k, which is calculated by the following equation: k =100/ (100+m)−1[percent], wherein a parameter m [percent] is a changing ratio in the reproducing speed of the second reproducing unit, which is changed based on the input signal.

The above music reproduction apparatus, further includes a key changing unit for changing a key of the main-sound, wherein the correcting unit corrects the key of the sub-sound in accordance with a change in the reproducing speed of the second reproducing unit and the changed key of the main-sound. A key of the main-sound is changed by a key changing unit, and the correcting unit corrects the key of the sub-sound in accordance with a change in the reproducing speed of the second reproducing unit and the changed key of the main-sound.

According to the music reproduction apparatus, the correcting unit corrects the key of the sub-sound by a parameter k', which is calculated by the following equation: k'=(100+a) / (100+m)−1 [percent], wherein a parameter a [percent] is a changing ratio in the key of the main-sound and wherein a parameter m [percent] is a changing ratio in the reproducing speed of the second reproducing unit, which is changed based on the input signal.

The nature, utility, and further features of this invention will be more clearly apparent from the following detailed description with respect to preferred embodiments of the invention when read in conjunction with the accompanying drawings briefly described below.

DESCRIPTION OF THE PREFERRED EMBODIMENTS

A preferred embodiment according to the present invention will now be described below with reference to the accompanying drawings.

In the preferred embodiment, in which the present invention is applied to a karaoke system, the karaoke system includes a music reproduction control system and a music reproduction system, which mixes accompaniment sound serving as main-sound supplied from a MIDI sound source and back-chorus serving as digitized sub-sound.

(I) Construction of Karaoke system

Firstly, the construction of the karaoke system as an embodiment will be explained with reference to FIG. 1 and FIG. 2.

Figure 1:
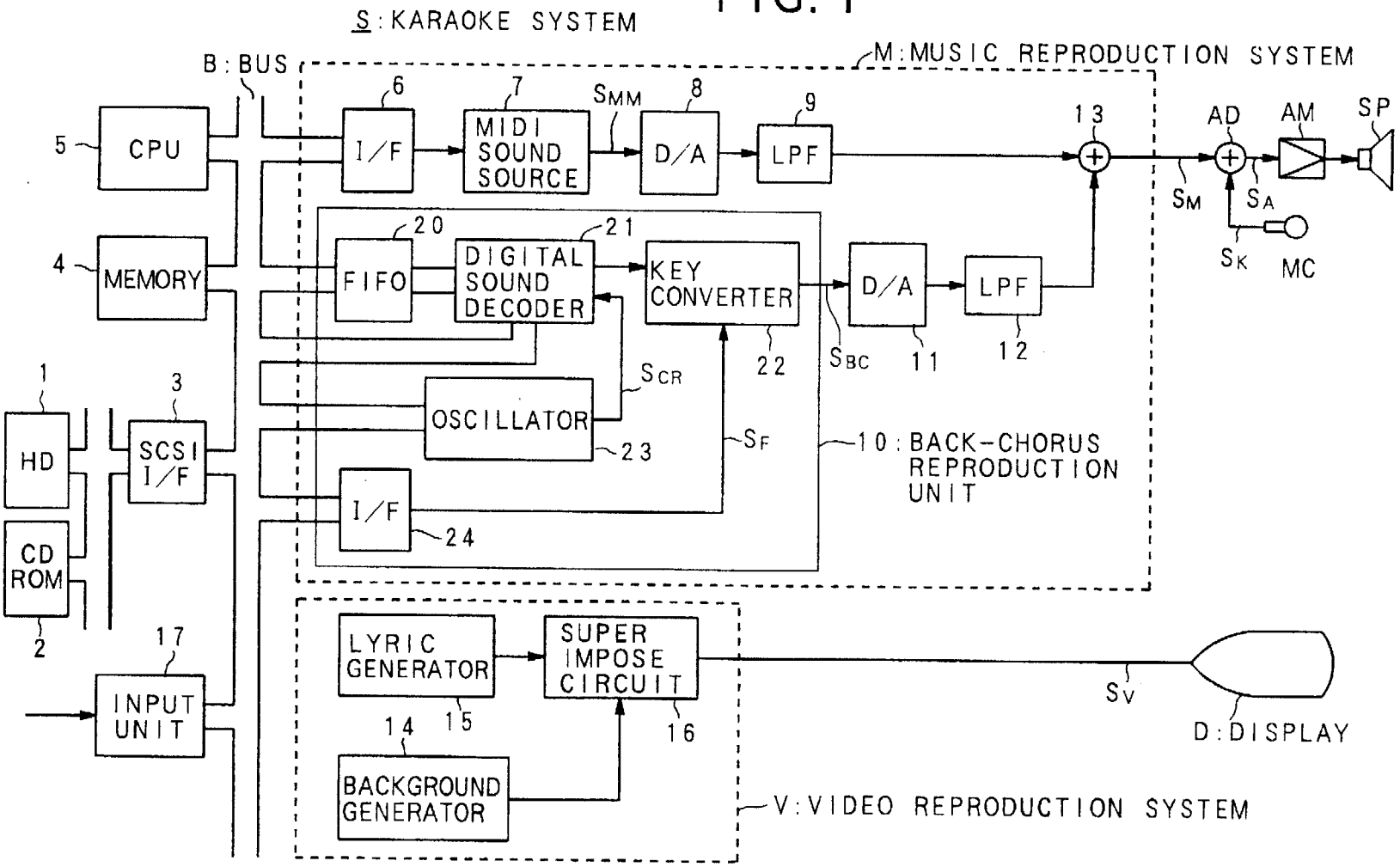
FIG. 1 is a block diagram illustrating a construction of so-called karaoke system.

As shown in FIG. 1, the karaoke system S according to the embodiment is provided with: a hard disk 1, in which MIDI data serving as main digital data and back-chorus data serving as sub-digital-data is recorded; a CD-ROM (Compact Disk-Read Only Memory) player 2 for reproducing a CD-ROM, in which the MIDI data and the back-chorus data is recorded; a SCSI (Small Computer System Interface) 3; a memory 4, which consists of a RAM (Random Access Memory), for temporarily storing data supplied from the hard disk 1, the CD-ROM player 2 and the SCSI 3; a music reproduction system M for reproducing music including accompaniment sound and back-chorus based on digital data stored in the memory 4 and outputting a music signal $S_M$ under the control of a CPU (Central Processing Unit) 5; a microphone MC for converting user's voice into a voice signal $S_K$; a mixer AD for mixing the music signal $S_M$ and the voice signal $S_K$ and a mixed signal $S_A$; an amplifier AM for amplifying the mixed signal $S_A$; a speaker SP for converting the mixed signal $S_A$ into aerial vibration; an image reproduction system V for reproducing background image including lyrics, which correspond to the music, and outputting an image signal $S_V$ under the control of the CPU 5; a display D, which consists of a CRT(Cathode-Ray Tube), for displaying an image based on the image signal $S_V$; an input unit 17 for outputting an input signal which controls the music reproduction system M and the image reproduction system V through the CPU 5 according to instructions from the user; a bus B for connecting the hard disk 1, the CD-ROM player 2, the SCSI interface 3, etc.; and the CPU 5, which serves as a main-sound output rate control system and a synchronous control system, for controlling the karaoke system S based on the input signal supplied from the input unit 17.

Nextly, with respect to the music reproduction system M shown in FIG. 1, a MIDI sound source system 7 reads a predetermined MIDI data from the memory 4 through a serial interface 6 and the bds B and outputs an accompaniment sound signal $S_{MM}$ based on the predetermined MIDI data under the control of the CPU 5. A digital to analog converter 8 converts the accompaniment sound signal $S_{MM}$, which consists of digital data into an analog accompaniment sound signal. A low-pass filter 9 eliminates high frequency noise from the converted analog accompaniment signal. A back-chorus reproduction unit 10 reads encoded bach-chorus data from the memory 4 through the bus B, decodes it and outputs a back-chorus signal $S_{BC}$. A digital to analog converter 11 converts the back-chorus signal $S_{BC}$, which consists of digital data, into an analog back-chorus signal. A low-pass filter 12 eliminates high frequency noise from the converted analog back-chorus signal. An adder 13, which serves as a mixing system, mixes the accompaniment sound signal $S_{MM}$ and the back-chorus signal $S_{BC}$, and then outputs the music signal $S_M$.

On the other hand, with respect to the image reproduction system V, a background generator 14 generates a background image, which corresponds to the music signal $S_M$. A lyric generator 15 generates lyric images, which correspond to the music signal $S_M$. Here, the lyric images are generated so that the color of the lyric image, which corresponds to the current music signal $S_M$, is changed. A superimpose circuit 16 mixes background images and lyric images, superimposes the lyric images upon the background images, and outputs the image signal $S_V$.

Nextly, the construction of the back-chorus reproduction unit 10 will be described below with reference to FIG. 1 and FIG. 2.

Figure 2:
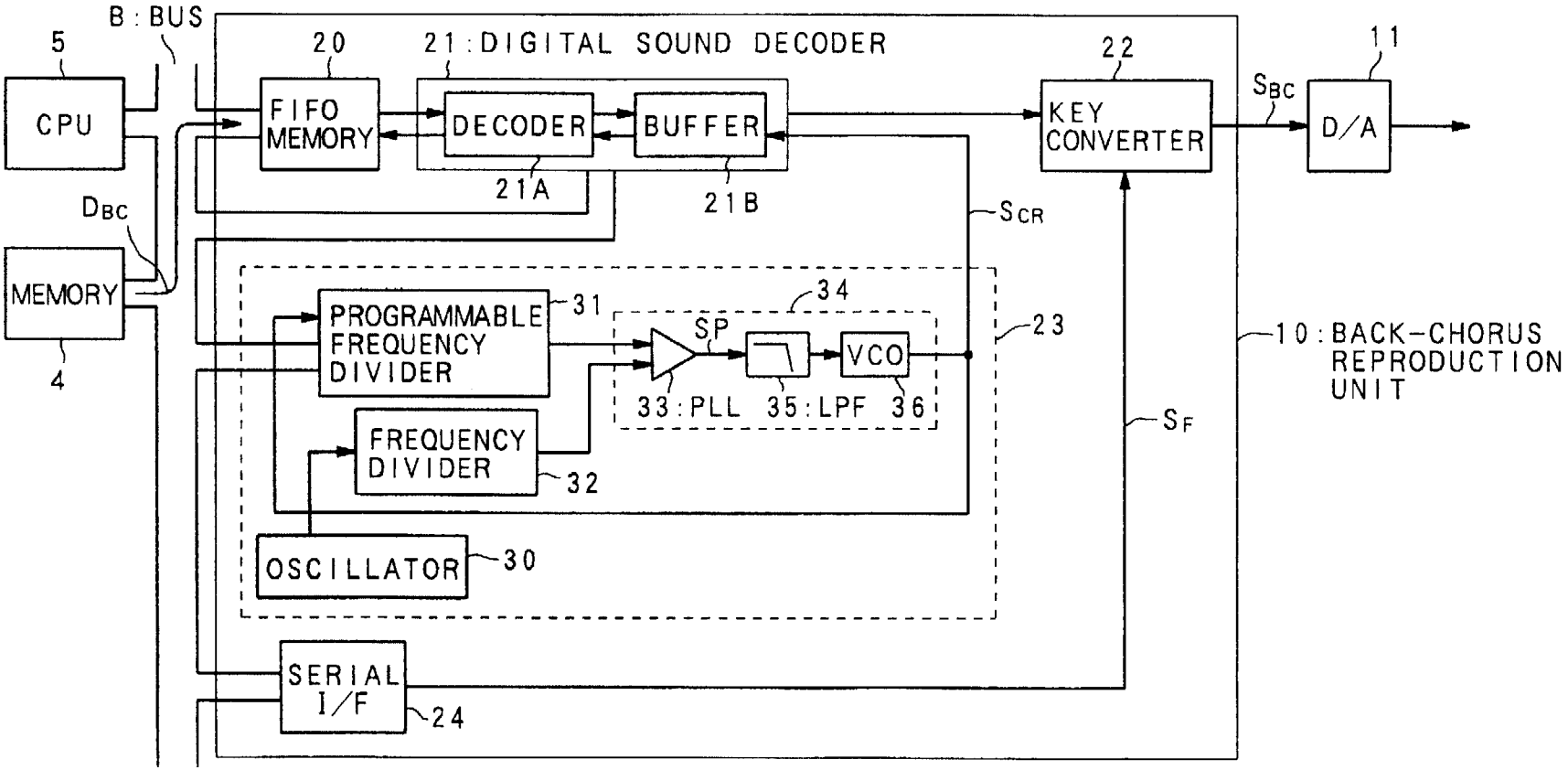
FIG. 2 is a diagram showing a construction of a back-chorus reproduction unit 10.

With respect to the back-chorus reproduction unit 10 shown in FIGS. 1 and 2, under the control of the CPU 5, a FIFO (First-In First-Out) memory 20 reads encoded back-chorus data $D_{BC}$ from memory 4 through the bus B, stores it temporarily, and outputs it in order of the storage. Here, the encoded back-chorus data $D_{BC}$ is compressed by the method of MPEG. A decoder unit 21A, which is included in a digital sound decoder 21 serving as the second reproducing unit, decodes the encoded back-chorus data $D_{BC}$ supplied from the FIFO memory 20. An output buffer 21B, which is included in the digital sound generator 21, outputs under the control of the CPU 5 the decoded back-chorus data at the reproducing speed of the back-chorus data, which is determined by an output control clock signal $S_{CR}$. Here, the digital sound generator 21 is initialized by the CPU 5 and the start of decoding and the end of the decoding is directly controlled by the CPU 5. The operations of the FIFO memory 20, the decoder unit 21A and the output buffer 21B will be explained hereinafter. A key converter 22, which serves as a correcting unit, corrects under the control of the CPU 5 the key of the back-chorus data based on a key control signal $S_F$ so that the corrected key corresponds to the reproducing speed of the back-chorus data and outputs a back-chorus signal $S_{BC}$. The operation of the key converter 22 will be explained hereinafter. A variable frequency oscillator 23, which serves as the second changing unit, controls the clock frequency of a output control clock signal $S_{CR}$ under the control of the CPU 5 so that the reproducing speed of the back-chorus data is varied based on the input signal supplied from the input unit 17.

The variable frequency oscillator 23 shown in FIG. 2 is provided with: an oscillator 30 for outputting a signal having a predetermined constant frequency; a programmable frequency divider 31, which has a dividing ratio being varied according to the input signal supplied from the input unit 17, for dividing a frequency of an output control clock signal $S_{CR}$ by the dividing ratio; a frequency divider 32 for dividing the frequency of the output signal supplied from the oscillator 30 by a predetermined dividing ratio; a PLL (Phase Locked Loop) circuit 33, which outputs the output control clock signal $S_{CR}$ based on the output signal of the programmable frequency divider 31 and the output signal of the frequency divider 32.

The PLL circuit 33 is provided with: a phase comparator 34 for comparing the phase of the output signal of the programmable divider 31 and that of the output signal of the divider 32 and outputting a comparison signal $S_P$; a low-pass filter 35 for eliminating the high frequency components of the comparison signal $S_P$; and a VCO (Voltage Controlled Oscillator) 36 for outputting the output control clock signal $S_{CR}$ based on the comparison signal $S_P$. Here, the output control clock signal $S_{CR}$ is supplied to the output buffer 21B and feedbacked to the programmable frequency divider 31.

(II) Operation of Karaoke System

Nextly, the operation of the karaoke system will be explained hereinafter by focusing on the variation in the reproducing speed of the MIDI sound source system 7 and that of the back-chorus reproduction unit 10.

In the beginning, the variation in the reproducing speed of the MIDI sound source system 7 will be explained with reference to FIG. 3.

As described before, the mixing of the accompaniment sound signal $S_{MM}$ Of the MIDI sound source system 7 is controlled by the CPU 5 and the MIDI data is controlled by a timing clock which corresponds to the period of one beat of the accompaniment sound divided by N (N is a natural number).

Figure 3:
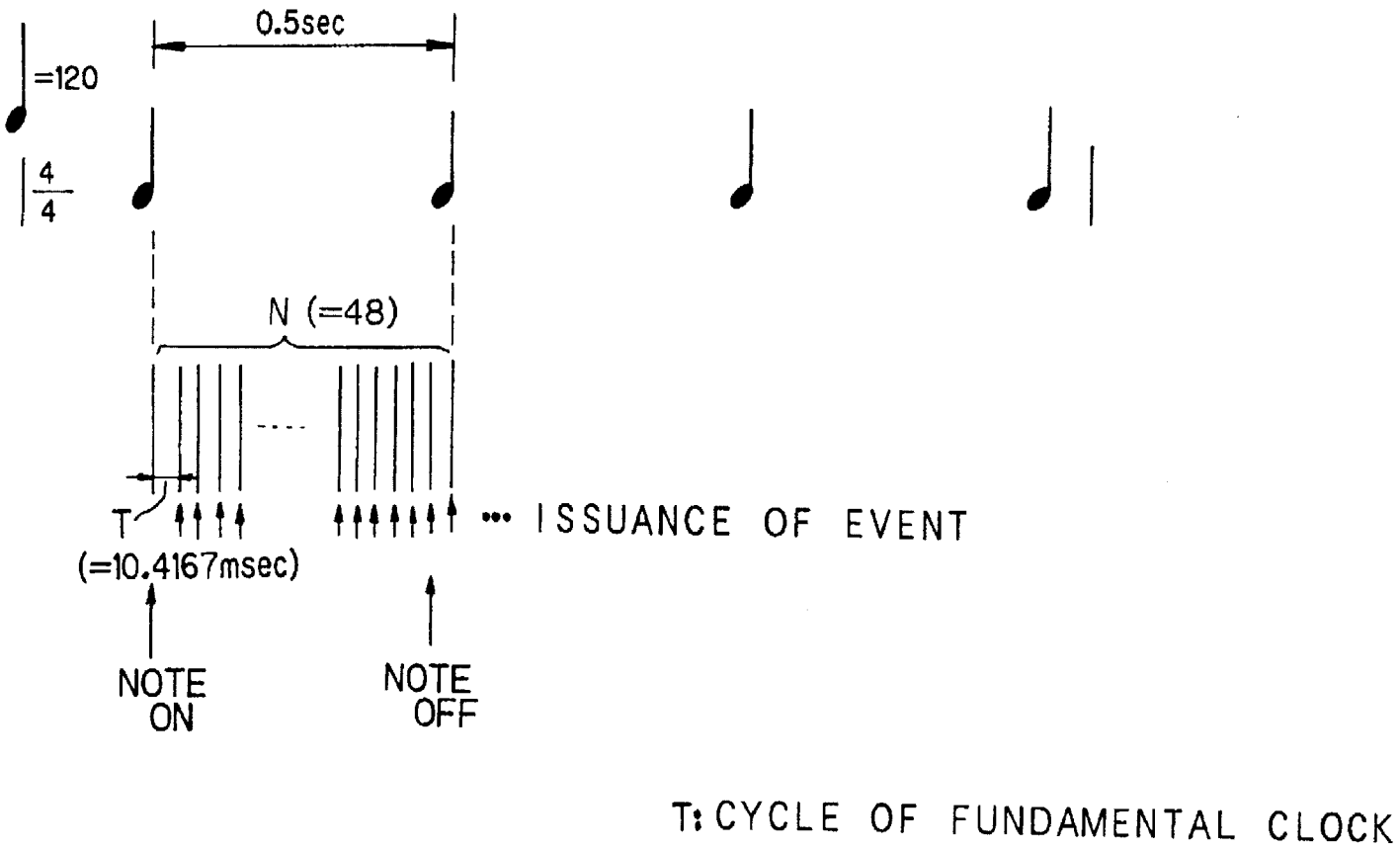
FIG. 3 is a diagram for explaining a change in a reproducing speed of a MIDI sound source system.

For example, as shown in FIG. 3, if a crotchet is played 120 times for one minute, the period of one beat, which is the period of one crotchet, is 60 (sec.)/120=0.5 (sec.).

And, generally, N is Greater then or equal to 48, and is less than or equal to 480. Therefore, if the value of N is 48, $$T=0.5\ (\text{sec.})/48=10.4167\ (\text{msec.})$$

Here, T is the cycle of the fundamental clock with respect to the mixing of the accompaniment sound of the MIDI sound source system 7. The CPU 5 outputs control codes for controlling sound volume, vibratos, the kind of musical instrument to be played, to the MIDI sound source system 7. The output of the control code is referred to as an issuance of an event hereinafter. The MIDI sound source 7 produces the accompaniment sound based on the control codes and outputs the accompaniment sound signal $S_{MM}$. For example, the issuance of an event "output a sound" corresponds to the output of the control code "NOTE ON" and the issuance of an event "stop the sound" corresponds to the output of the control code "NOTE OFF".

With respect to the MIDI sound source system 7, the reproducing speed can be easily varied by changing the period of the fundamental clock T. For example, if the cycle of the fundamental clock is varied from T to T'(=0.9T), the reproducing speed is increased by 10 percent. Here, $$T'=0.9T=0.9\times10.4167\ (\text{msec})=9{,}375\ (\text{msec})$$

The cycle of the fundamental clock is varied based on the input signal supplied from the input unit 17 under the control of the CPU 5.

In this example, while the cycle of the fundamental clock is varied, the key of the accompaniment sound to be reproduced is not varied.

Nextly, the variation in the reproducing speed of the back-chorus reproduction unit 10 will be explained hereinafter with reference to FIG. 2 and FIG. 3.

With respect to the back-chorus reproduction unit 10, the reproducing speed is varied by changing the frequency of the output control clock signal $S_{CR}$ in accordance with the input signal supplied from the input unit 17 and changing the output rate of the output buffer 21B.

The operations of the FIFO memory 20, the decoder unit 21A and the output buffer 21B will be explained with reference to FIGS. 2 and 4. With respect to the operation shown in FIG. 4, the CPU 5 controls the FIFO memory 20, the decoder unit 21A and the output buffer 21B through the bus B.

Figure 4:
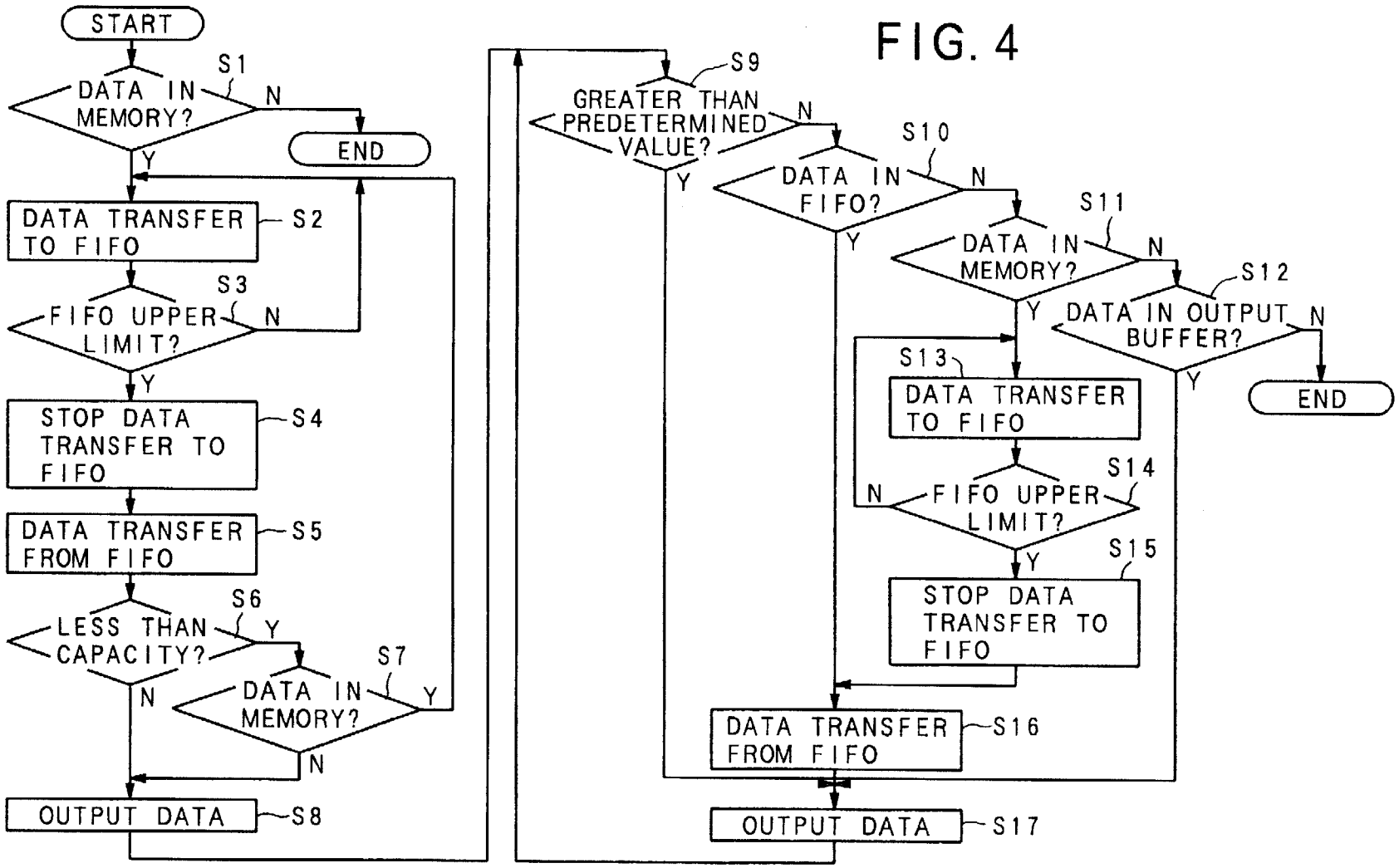
FIG. 4 is a flowchart illustrating an operation of a decoder unit.

With respect to a flowchart shown in FIG. 4, steps S1–S8 relate to the operation of storing the decoded back-chorus data into the output buffer 21B and the beginning of outputting the back-chorus data due to the output buffer 21B being saturated. Steps S9–S17 relate to the operation of the decoder unit 21A, which decodes the encoded back-chorus data $D_{SC}$ so that the quantity of the data stored in the output buffer 21B is not zero based on the quantity of the data stored in the FIFO memory 20 and the quantity of the data stored in the output buffer 21B.

As shown in the flowchart of FIG. 4, firstly, the CPU 5 judges whether or not the encoded back-chorus data $D_{BC}$ to be decoded is stored in the memory 4 (Step S1). If the encoded back-chorus data $D_{BC}$ to be decoded is not stored in the memory 4 (Step S1; N), the decoding process is completed. If the encoded back-chorus data $D_{BC}$ to be decoded is stored in the memory 4 (Step S1; Y), the encoded back-chorus data $D_{SC}$ is transferred from the memory 4 to the FIFO memory 20 (Step S2).

Nextly, the CPU 5 judges whether or not the quantity of the encoded back-chorus data $D_{BC}$ stored in the FIFO memory 20 is greater than or equal to a predetermined upper limit (Step S3), and if the quantity of the encoded back-chorus data $D_{BC}$ stored in the FIFO memory 20 is less than the predetermined upper limit (Step S3; N), the step S2 is repeated. If the quantity of the encoded back-chorus data $D_{BC}$ stored in the FIFO memory 20 is greater than or equal to a predetermined upper limit (Step S3; Y), the data transfer from the memory 4 to the FIFO memory 20 (Step S2) is completed (Step S4), and then the decoder unit 21A decodes the encoded back-chorus data $D_{BC}$ stored in the FIFO memory 20 and transfers the decoded back-chorus data to the output buffer 21B (Step S5).

Nextly, the CPU 5 judges whether or not the quantity of the back-chorus data transferred from the decoder unit 21A is less than the capacity of the output buffer 21B (Step S6). If the quantity of the back-chorus data transferred from the decoder unit 21A is less than the capacity of the output buffer 21B (Step S6; Y), the CPU 5 judges whether or not the encoded back-chorus data $D_{BC}$ is stored in the memory 4 (Step S7), and if the encoded back-chorus data $D_{BC}$ is stored in the memory 4 (Step S7; Y), the steps S2–S6 are repeated. If the quantity of the back-chorus data transferred from the decoder unit 21A is equal to the capacity of the output buffer 21B (Step S6; N) or if the encoded back-chorus data $D_{BC}$ is not stored in the memory 4 (Step S7; N), the back-chorus data is outputted based on the output control clock signal $S_{CR}$ at the reproducing speed, which corresponds to the frequency of the output control clock signal $S_{CR}$ (Step S8).

Nextly, the CPU 5 judges whether or not the quantity of the data stored in the output buffer 21B is greater than or equal to a predetermined value (Step S9). If the quantity of the data stored in the output buffer 21B is greater than or equal to a predetermined value (Step S9; Y), the back-chorus data is outputted based on the output control clock signal $S_{CR}$ at the reproducing speed, which corresponds to the frequency of the output control clock signal $S_{CR}$ (Step S17). Here, the predetermined data is determined based on the reproducing speed of the output buffer 21B.

If the quantity of the data stored in the output buffer 21B is less than the predetermined value (Step S9; N), the CPU 5 judges whether or not the encoded back-chorus data $D_{BC}$ to be decoded is stored in the FIFO memory 20 (Step S10). If the encoded back-chorus data $D_{BC}$ to be decoded is stored in the FIFO memory 20 (Step S10; Y), the decoder unit 21A decodes the encoded back-chorus data $D_{BC}$ stored in the FIFO memory 20 and transfers the decoded back-chorus data to the output buffer 21B (Step S16). If the encoded back-chorus data $D_{BC}$ to be decoded is not stored in the FIFO memory 20 (Step S10; N), the CPU 5 judges whether or not the encoded back-chorus data $D_{BC}$ is stored in the memory 4 (Step S11), and if the encoded back-chorus data $D_{BC}$ is not stored in the memory 4 (Step S11; N), the CPU 5 judges whether or not the encoded back-chorus data $D_{BC}$ is stored in the output buffer 21B (Step S12), and if the encoded back-chorus data $D_{BC}$ is not stored in the output buffer 21B (Step S12; N), the operation shown in FIG. 4 is completed. If the encoded back-chorus data $D_{BC}$ is stored in the output buffer 21B (Step S12; Y), the back-chorus data is outputted based on the output control clock signal $S_{CR}$ at the reproducing speed, which corresponds to the frequency of the output control clock signal $S_{CR}$ (Step S17).

If the encoded back-chorus data $D_{BC}$ is stored in the memory 4 (Step S11; Y), the encoded back-chorus data $D_{BC}$ is transferred from the memory 4 to the FIFO memory 20 (Step S13) and the CPU 5 judges whether or not the quantity of the encoded back-chorus data $D_{BC}$ stored in the FIFO memory 20 is greater than or equal to a predetermined upper limit (Step S14), and if the quantity of the encoded back-chorus data $D_{BC}$ stored in the FIFO memory 20 is less than the predetermined upper limit (Step S14; N), the encoded back-chorus data $D_{BC}$ is transferred from the memory 4 to the FIFO memory 20 (Step S13). If the quantity of the encoded back-chorus data $D_{BC}$ stored in the FIFO memory 20 is greater than or equal to a predetermined upper limit (Step S14; Y), the data transfer from the memory 4 to the FIFO memory 20 is completed (Step S15), the decoder unit 21A decodes the encoded back-chorus data $D_{BC}$ stored in the FIFO memory 20 and transfers the decoded back-chorus data to the output buffer 21B (Step S16), and the back-chorus data is outputted based on the output control clock signal $S_{BC}$ at the reproducing speed, which corresponds to the frequency of the output control clock signal $S_{CR}$ (Step S17). After the step S17, the steps S9–S17 are repeated.

As described the above, the quantity of the encoded back-chorus data $D_{BC}$ stored in the FIFO memory 20 and the decoding by the decoder unit 21A is controlled so that the quantity of the data stored in the output buffer 21B is not zero. The quantity of the data stored in the output buffer 21B being zero means that the output of the output buffer 21B is zero. Namely, in this case, the back-chorus signal $S_{BC}$ not supplied and the back-chorus is interrupted during the music signal $S_M$ being reproduced.

Accordingly, the input speed and the output speed of the FIFO memory 20 and the decoding speed of the decoder unit 21A is controlled based on the variation in the output speed of the data outputted from the output buffer 21B. Therefore, in this example, the output speed of the back-chorus data supplied from the output buffer 21B is varied by varying the frequency of the output control clock signal $S_{CR}$, by which the output speed of the back-chorus data supplied from the output buffer 21B is determined, based on the input signal supplied from the input unit 17. As controlled as such, the outputted back-chorus data is not interrupted.

The variation in the output speed of the back-chorus data supplied from the output buffer 21B means that the variation in the reproducing speed of the back-chorus data.

Nextly, the operation of the variable frequency oscillator 23, which varies the frequency of the output control clock signal $S_{CR}$ based on the input signal supplied from the input unit 17, will be explained with reference to FIG. 2. The input signal, which is supplied from the input unit 17, for varying the reproducing speed is supplied to the CPU 5. The dividing ratio of the programmable frequency divider 31 is varied based on the input signal supplied from the input unit 17 under the control of the CPU 5. The output control clock signal $S_{CR}$ is feedbacked to the programmable frequency divider 31 and the frequency of the output control clock signal $S_{CR}$ is divided by the dividing ratio varied by the CPU 5.

On the other hand, the oscillator 30 outputs a signal having a predetermined frequency, and the signal is supplied to the divider 32 having a predetermined dividing ratio. The output signal of the programmable frequency divider 31 and the output signal of the divider 32 are supplied to the phase-comparator 34, which outputs the comparison signal $S_P$ corresponding the phase difference between the output signal of the programmable frequency divider 31 and the output signal of the divider 32. The comparison signal $S_P$ is supplied to the VCO 36, in which the frequency of the output control clock signal $S_{CR}$ is controlled in accordance with the comparison signal $S_P$.

For example, in the present example, a frequency $f_S$, which is the sampling frequency of the decoder unit 21A, is 44.1 kHz. A frequency $f_{SCR}$, which is a frequency of the output control clock signal $S_{CR}$, is calculated as follows:

$$f_{SCR}=512\times f_S=22.5792\ MHz$$

A frequency of the oscillator 30 is 22.5792 MHz, the dividing ratio of the divider 32 is 1/100, and the dividing ratio of the programmable frequency divider 31 is 1/(100+m). A parameter m [percent] for changing the reproducing speed is varied by the CPU 5 based on the input signal.

If the frequency $f_{SCR}$ of the output control clock signal $S_{CR}$ is varied by every one percent between 0.9 $f_{SCR}$ and 1.1 $f_{SCR}$, the parameter m is varied between −10 and 10.

If the reproducing speed is increased by 4 percent, the parameter m is equal to 4. In this case, the frequency of the output signal from the VCO 36, that is the frequency $f_{SCR}$ of the output control clock signal $S_{CR}$, is varied from 22.5792 MHz to 23.482 MHz. Accordingly, the output speed of the output buffer 21B in case of the parameter m being 4 is increased by 4 percent compared with that in case of the parameter m being 0. Therefore, the reproducing speed of the back-chorus data in case of the parameter m being 4 is increased by 4 percent compared with that in case of the parameter m being 0.

The upper limit and the lower limit of the variable frequency $f_{SCR}$ of the output control clock signal $S_{CR}$ is determined based on the upper limit and the lower limit of the total input and output speed with respect to the decoding, which includes the upper limit and the lower limit of the input and output speed of the FIFO memory 20; the upper limit and the lower limit of the decoding speed of the decoder unit 21A; and the upper limit and the lower limit of the input and output speed of the output buffer 21B.

Further, as described before, when the reproducing speed of the back-chorus data is varied, the cycle T of the fundamental clock with respect to the mixing of the accompaniment sound of the MIDI sound source system 7 is also varied at the same variation factor as that of the reproducing speed of the back-chorus data. The synchronism between the back-chorus data and the accompaniment sound will be explained hereinafter.

As described before, the frequency of the output control clock signal $S_{CR}$ is controlled in accordance with the input signal, and the reproducing speed of the back-chorus is varied. If the reproducing speed is varied, the key of reproduced sound is varied. Namely, the faster the reproducing speed becomes, the higher the key of reproduced sound becomes.

Nextly, the construction and the operation of the key converter 22, which corrects the key of the back-chorus if the reproducing speed of the back-chorus is changed, will be explained with reference to FIG. 2.

The key converter 22, which is so called a key-controller, is provided with an input-output control unit, which controls the data input-output speed of the RAM.

Digital back-chorus data supplied from the output buffer 21B is stored into the RAM at a constant speed in order of the address of the data under the control of the input-output control unit. While the stored back-chorus data is read in order of the address, the input-output control unit has the reading speed being higher than that of the storing speed if the key becomes higher, and has the reading speed being lower than that of the storing speed if the key becomes lower.

The key converter 22 corrects the key based on the key control signal $S_F$ depending on the parameter m. With respect to the key converter 22, a key change parameter k [percent] is described as follows:

$$k=100/(100+m)-1 \quad (1)$$

The input-output control unit controls the storing speed and the reading speed based on the key change parameter k, and the key is varied.

For example, if the parameter m is equal to 4 [percent], then the parameter k is equal to −3.85 [percent]. In this case, the key converter 22 decreases the key of the back-chorus data by 3.85 percent. If the sign of the parameter k is positive, the key is increased.

If the key converter is controlled so that the storing speed is constant while the key is varied as described before, the RAM overflows or underflows. Namely, if the key is increased, the reading speed becomes faster than the storing speed and, therefore, the RAM underflows. On the other hand, if the key is decreased, the reading speed becomes slower than the storing speed and, therefore, the RAM overflows.

Figure 5A:
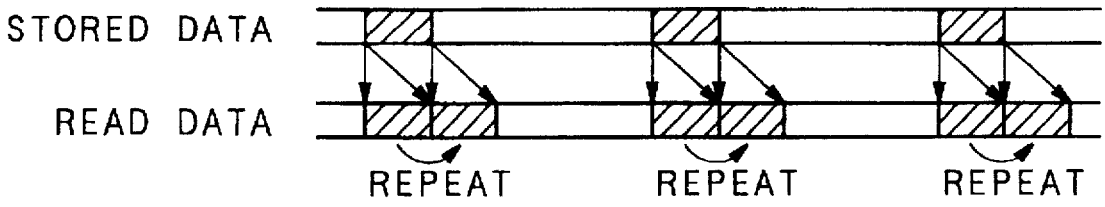
FIG. 5A and 5B are drawings depicting an operation of a key converter.
Figure 5B:
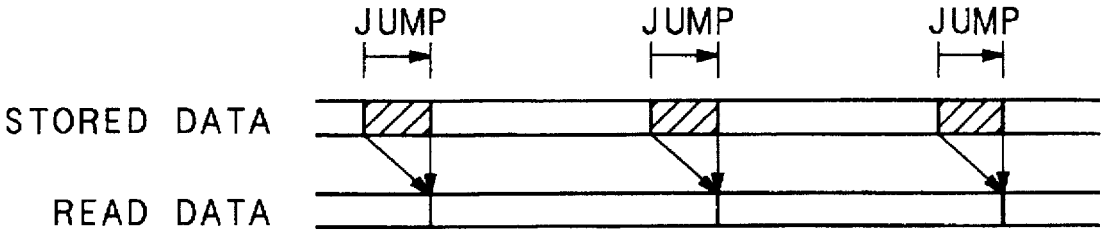

Therefore, the key converter 22 repeatedly reads data located within the hatched portion shown in FIG. 5(*a*), so that the RAM does not underflow, or the key converter 22 jumps data located within the hatched portion shown in FIG. 5(*b*) so that the RAM does not overflow. However, the reproduced back-chorus data may be discontinuous if the data in the hatched area is repeatedly read or jumped. Therefore, if the reproduced back-chorus data is discontinuous, both of the data located in predetermined addresses before the repeatedly read or jumped address and the data located in predetermined addresses after the repeatedly read or jumped address are read, and then the data located in the addresses before the repeatedly read or jumped address is faded out, and the data located in the addresses after the repeatedly read or lumped address is faded in, and then the discontinuity is avoided.

As explained the above, since the key converter 22 corrects the variation in the key due to the variation in the reproducing speed of the back-chorus data in accordance with the parameter m, the back-chorus signal $S_{BC}$, the reproducing speed of which is varied and which has the same key as that in case of the reproducing speed being not varied, is supplied to the digital to analog converter 11.

The operation of the key converter 22 in case of the key of the whole music signal, which consists of the accompaniment sound from the MIDI sound source system 7 and the back-chorus, being not changed is explained the above. If it is instructed that the key of the whole music signal is changed, the key is changed by the key converter 22. Namely, if it is instructed by the input signal supplied from the input unit 17 that the key of the whole music signal is changed, the CPU 5 instructs the MIDI sound source system 7 to change the key and inputs a music signal key parameter a [percent] to the key converter 22. Here, the parameter a represents a change ratio of the key by a variation ratio of a frequency. For example, if the variation range of the key is between −5 semitone and +5 semitone, the parameter a is between −30 percent and +30 percent. The key converter 22 corrects the key of the back-chorus by using a key change parameter k' based on the parameter a and the parameter m. The parameter k' is defined as follows:

$$k'=(100+a)/(100+m)-1 \quad (2)$$

According to the above equation (2), for example, if it is instructed that the reproducing speed is increased by 6 percent and that the key is increased by the semitone, which corresponds to the parameter a being 6 percent, the parameter k' is equal to zero, which means that the key converter 22 does not correct the key of the back-chorus data.

Nextly, the timing of the variation in the reproducing speed of the MIDI sound source system 7 and the timing of the variation in the reproducing speed of the back-chorus reproduction unit 10 will be explained with reference to FIG. 6.

Figure 6:
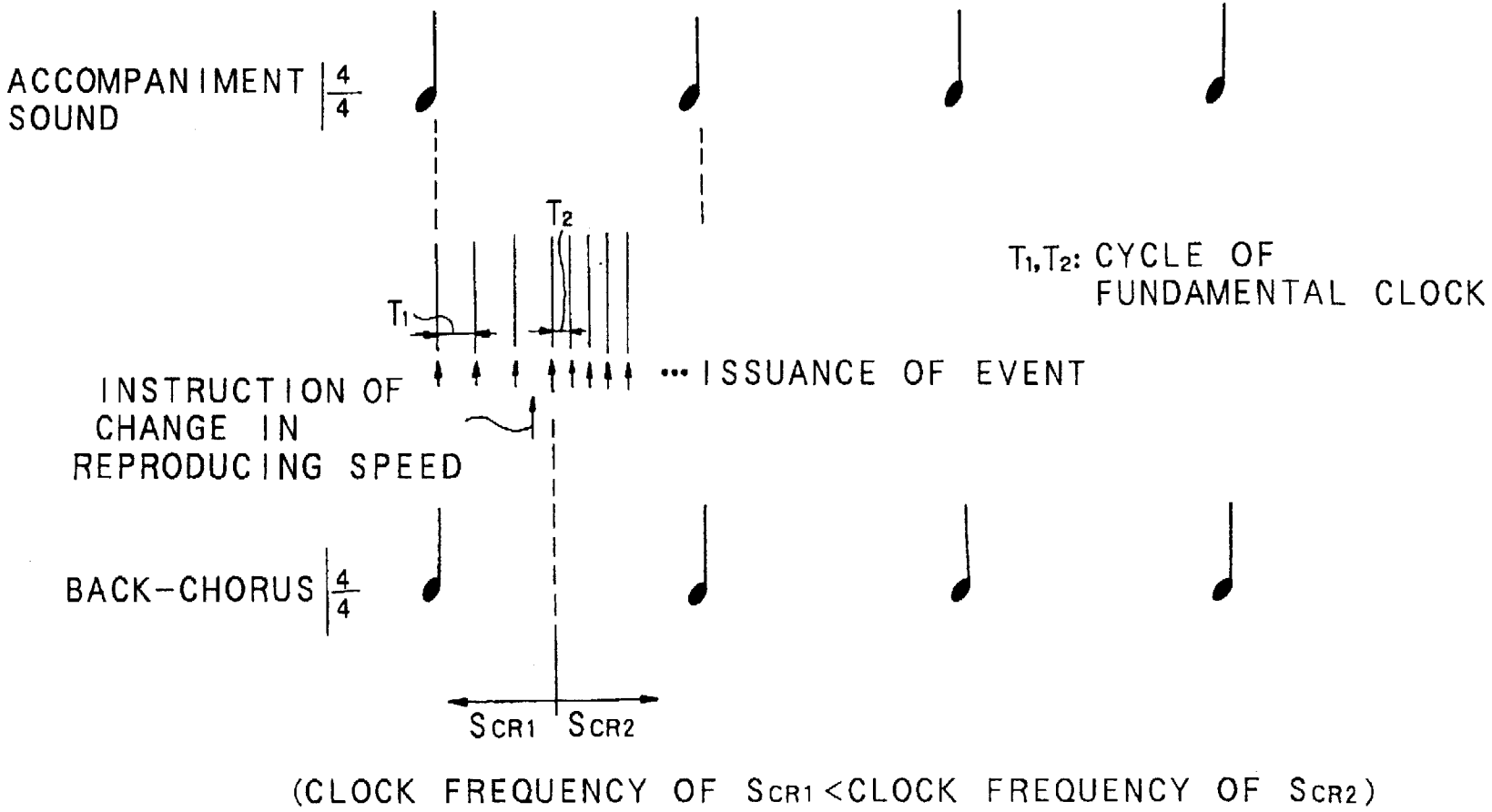
FIG. 6 is a diagram for explaining a synchronization between an accompaniment sound and a back-chorus.

As shown in FIG. 6, the timing of the variation in the reproducing speed of the MIDI sound source system 7 is synchronized with the timing of the variation in the reproducing speed of the back-chorus reproduction unit 10 under the control of the CPU 5 by changing the fundamental clock cycle of the MIDI sound source system 7 from $T_1$ to $T_2$ at the timing of the output of the control code after the instruction for changing the reproducing speed being recognized by the CPU 5, and by changing the output control clock signal from $S_{CR1}$ to $S_{CR2}$ at the same timing. Here, if $T_1$ is greater than $T_2$, the frequency of the output control clock signal $S_{CR1}$ is less than that of the output control clock signal $S_{CR2}$.

As explained the above, according to the present embodiment, since the frequency of the output control clock signal $S_{CR}$ is controlled based on the input signal and the output speed of the digital sound decoder 21 is controlled based on the output control clock signal $S_{CR}$, the reproducing speed of the back-chorus signal $S_{BC}$ can be changed in synchronism with the timing of the variation in the reproducing speed of the accompaniment sound signal $S_{MM}$ supplied from the MIDI sound source system 7. Additionally, since the key of the back-chorus signal $S_{BC}$ is corrected in accordance with the variation in the reproducing speed of the back-chorus signal $S_{BC}$, both of the reproducing speed of the accompaniment sound and that of the back-chorus can be changed by the same change ratio at the same time by the user and the key of the back-chorus is not changed due to the reproducing speed of the back-chorus being changed.

Further, since the encoded back-chorus data is stored into the memory 4 under the condition of the back-chorus data being compressed, the capacities of the memory 4 and the FIFO memory 20 can be decreased.

(III) Modification

In the above embodiment, as an example of the sub-sound, the back-chorus of the karaoke system is explained. However, the present invention is not limited to the above embodiment. The present invention can be applied to the exclusive use of the reproduction of the music, which is not for the purpose of karaoke, for example, the reproduction of the accompaniment sound and the back-chorus.

Further, if voices such as the back-chorus and images, which corresponds to the voices, are stored into the memory 4 as digitized data, the voices and the images are outputted by decoding the digitized data, then the voices and the images may be mixed with the accompaniment sound. In this case, the reproducing speed of the images are changed in accordance with the variation in the reproducing speed of the voices. Additionally, in this case, the image reproduction system V of the above embodiment may not be provided, or the decoded images may be superimposed on the images reproduced by the image reproduction system V.

Further, in the present embodiment, when the encoded back-chorus data is decoded, the reproducing speed of the back-chorus data is changed by changing the frequency of the output control clock signal $S_{CR}$. The present invention is not limited to the embodiment. However, in another modification, the reproducing speed of the back-chorus data may be changed by storing the uncompressed back-chorus data into the memory 4 and by changing the reading speed of the uncompressed back-chorus data. In this case, the FIFO memory 20 and the digital sound decoder 21 is not needed.

Further, in the above present embodiment, the hard disk 1, the CD-ROM player 2 and other systems are connected through the SCSI 3 and the bus B. However, the present invention is not limited to the above present embodiment. In case of a communication karaoke system, the MIDI data and the back-chorus data may be down loaded to memory 4 as a musical piece data from the host computer and may be stored into the hard disk 1 by connecting the communication karaoke system and the host computer through a telephone line.

According the present invention, since a reproducing speed of the second reproducing means is changed by a second changing means based on the received input signal and a key of the sub-sound is corrected by a correcting means in accordance with a change in the reproducing speed of the second reproducing means, the reproducing speed of the sub-sound can be changed in accordance with the change in the reproducing speed of the main-sound, and the key of the sub-sound is not changed if the reproducing speed of thereof is changed.

The present invention may be embodied in other preferred forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A music reproduction control apparatus comprising:

a first storing means for storing main-digital data;

a second storing means for storing sub-digital data;

a first reproducing means for reproducing main-sound based on the stored main-digital data;

a second reproducing means for reproducing sub-sound based on the stored sub-digital data;

a receiving means for receiving an input signal;

a first changing means for changing a reproducing speed of the first reproducing means based on the received input signal;

a second changing means for changing a reproducing speed of the second reproducing means based on the received input signal;

a correcting means for correcting a key of the sub-sound in accordance with a change of the reproducing speed of the second reproducing means; and a synchronizing means for synchronizing a timing of changing the reproducing speed of the first reproducing means with a timing of changing the reproducing speed of the second reproducing means wherein said first changing means and said second changing means change the reproduction speed during the reproduction of the main-sound and the sub-sound.

2. A music reproduction control apparatus according to claim 1, wherein the second changing means further comprises:

a first signal outputting means for outputting a first signal having a first phase;

a second signal outputting means for outputting a second signal having a second phase, which is changed based on the received input signal; and a phase difference detecting means for outputting a control signal corresponding to a phase difference between the first phase and the second phase, whereby the second changing means changes the reproducing speed of the second reproducing means based on the control signal.

3. A music reproduction control apparatus according to claim 1, wherein the correcting means corrects the key of the sub-sound by a parameter k, which is calculated by the following equation:

$$k=100/(100+m)-1$$

wherein a parameter, m, expressed as a percentage is a changing ratio in the reproducing speed of the second reproducing means, which is changed based on the input signal.

4. A music reproduction control apparatus according to claim 1, further comprising a key changing means for changing a key of the main-sound, wherein the correcting means corrects the key of the sub-sound in accordance with a change in the reproducing speed. Of the second reproducing means and the changed key of the main-sound.

5. A music reproduction control apparatus according to claim 1, wherein the correcting means corrects the key of the sub-sound by a parameter k', which is calculated by the following equation:

$$k'=(100+a)/(100+m)-1$$

wherein a parameter, a, expressed as a percentage is a changing ratio in the key of the main-sound and wherein a parameter, m, expressed as a percentage, is a changing ratio in the reproducing speed of the second reproducing means, which is changed based on the input signal.

6. A music reproduction apparatus according to claim 1, wherein said correcting means corrects the key of the sub-sound simultaneously with the reproduction speed changes by said first changing means and said second changing means.

7. A music reproduction apparatus according to claim 1, wherein said receiving means receives the input signal during the reproduction of the main-sound and the sub-sound.

8. A music reproduction apparatus comprising:

a first storing means for storing main-digital data;

a second storing means for storing sub-digital data;

a first reproducing means for reproducing main-sound based on the stored main-digital data;

a second reproducing means for reproducing sub-sound based on the stored sub-digital data;

a receiving means for receiving an input signal;

a first changing means for changing a reproducing speed of the first reproducing means based on the received input signal;

a second changing means for changing a reproducing speed of the second reproducing means based on the received input signal;

a correcting means for correcting a key of the sub-sound in accordance with a change of the reproducing speed of the second reproducing means;

a synchronizing means for synchronizing a timing of changing the reproducing speed of the first reproducing means with a timing of changing the reproducing speed of the second reproducing means; and a mixing means for mixing the main-sound and the sub-sound after the reproducing speed of the first reproducing means is changed by the first changing means and the reproducing speed of the second reproducing means is changed by the second changing means, wherein said first changing means and said second changing means change the reproduction speed during the reproduction of the main-sound and the sub-sound.

9. A music reproduction apparatus according to claim 8, wherein the second changing means further comprises:

a first signal outputting means for outputting a first signal having a first phase;

a second signal outputting means for outputting a second signal having a second phase, which is changed based on the received input signal; and a phase difference detecting means for outputting a control signal corresponding to a phase difference between the first phase and the second phase, whereby the second changing means changes the reproducing speed of the second reproducing means based on the control signal.

10. A music reproduction apparatus according to claim 8, wherein the correcting means corrects the key of the sub-sound by a parameter k, which is calculated by the following equation:

$$k=100/(100+m)-1$$

wherein a parameter, m, expressed as a percentage is a changing ratio in the reproducing speed of the second reproducing means, which is changed based on the input signal.

11. A music reproduction apparatus according to claim 8, further comprising a key changing means for changing a key of the main-sound, wherein the correcting means corrects the key of the sub-sound in accordance with a change in the reproducing speed of the second reproducing means and the changed key of the main-sound.

12. A music reproduction apparatus according to claim 8, wherein the correcting means corrects the key of the sub-sound by a parameter k', which is calculated by the following equation:

$$k'=(100+a)/(100+m)-1$$

wherein a parameter, a, expressed as a percentage, is a changing ratio in the key of the main-sound and wherein a parameter, m, expressed as a percentage, is a changing ratio in the reproducing speed of the second reproducing means, which is changed based on the input signal.

13. A music reproduction apparatus according to claim 8, wherein said correcting means corrects the key of the sub-sound simultaneously with the reproduction speed changes by said first changing means and said second changing means.

14. A music reproduction apparatus according to claim 8, wherein said receiving means receives the input signal during the reproduction of the main-sound and the sub-sound.

* * * * *